US006655629B1

(12) United States Patent
Acciari

(10) Patent No.: US 6,655,629 B1
(45) Date of Patent: Dec. 2, 2003

(54) APPARATUS AND METHOD FOR PREPARING WINDING MANDRELS AND CORES FOR REWINDING MACHINES

(75) Inventor: Giuseppe Acciari, Lucca (IT)

(73) Assignee: A. Celli S.P.A., Porcari (IT)

( * ) Notice: Subject to any disclaimer, the term of this patent is extended or adjusted under 35 U.S.C. 154(b) by 0 days.

(21) Appl. No.: 09/958,760

(22) PCT Filed: Apr. 10, 2000

(86) PCT No.: PCT/IT00/00133

§ 371 (c)(1),
(2), (4) Date: Nov. 29, 2001

(87) PCT Pub. No.: WO00/61480

PCT Pub. Date: Oct. 19, 2000

(30) Foreign Application Priority Data

Apr. 12, 1999 (IT) ..... FI99A0085

(51) Int. Cl.[7] ..... B65H 67/00
(52) U.S. Cl. ..... 242/533; 242/533.1; 242/533.7
(58) Field of Search ..... 242/530.1, 530.3, 242/533, 533.1, 533.7

(56) References Cited

U.S. PATENT DOCUMENTS 4,422,588 A 12/1983 Nowisch
5,217,177 A 6/1993 Stefanoni
6,047,916 A * 4/2000 Onnerlov ..... 242/533.1
6,129,304 A * 10/2000 Biagiotti ..... 242/530.1

FOREIGN PATENT DOCUMENTS

| | | |
|---|---|---|
| EP | 0 747 308 | 12/1996 |
| EP | 0 767 123 | 4/1997 |
| EP | 0 943 569 | 9/1999 |
| GB | 891315 | 3/1962 |
| GB | 913797 | 12/1962 |
| WO | WO 99/02439 | 1/1999 |

* cited by examiner

*Primary Examiner*—Kathy Matecki
*Assistant Examiner*—Sang Kim
(74) *Attorney, Agent, or Firm*—McGlew and Tuttle, P.C

(57) ABSTRACT

A description is given of a device for preparing winding mandrels for winding machines or the like, comprising, in combination: an extraction station (9) with an extractor mechanism for extracting a mandrel from one or more rolls of web material and for inserting the extracted mandrel into a tube (T); a cutting station (11) with cutting means (71) for cutting the tube (T) fitted on the mandrel into a set of tubular cores aligned on said mandrel; an insertion station (13) with insertion members (127) for inserting the mandrel with the tubular cores into a winding machine or the like.

52 Claims, 7 Drawing Sheets

59
75
63
11
53
57
65
68C
68A
69
68B
55
89
61
85
71
83
81
87
91
FT
57
67
66
79
89
T
43
35
93
99
51
51
101
100

59
75
53
57
65
77
79
63
67
68A
68B
69
61
85
57
67
66
71
83
81
T
87
35
51
51

APPARATUS AND METHOD FOR PREPARING WINDING MANDRELS AND CORES FOR REWINDING MACHINES

TECHNICAL FIELD

The present invention relates to an apparatus for preparing winding mandrels with corresponding tubular winding cores fitted on them for introduction into rewinding machines or other winding machines.

STATE OF THE ART

In various industrial sectors, for example in the paper converting industry, the textile industry and the production of nonwoven textiles, it is frequently necessary to wind on to rolls of smaller or larger diameter a web material taken from a reel of greater diameter. Frequently, a plurality of rolls of smaller height are formed simultaneously by winding strips of web material generated by longitudinally cutting a single strip taken from the reel of greater diameter. The strips are wound on tubular cores adjacent to each other and carried by an expanding winding mandrel. An example of a machine for carrying out this type of winding is described in EP-A-0747308.

In some cases, the rolls which are formed simultaneously on the cores fitted on to the mandrel have heights (in other words, axial lengths) which differ from each other. Usually, one or more operators prepare the tubular cores which have previously been cut from a continuous tube, fitting them on to one or more mandrels positioned outside the rewinding machine, and then, at the start of each winding cycle, insert the individual mandrels, fitted with the corresponding tubular cores, into the rewinding machine. This procedure is time-consuming, tiring, and labor-intensive.

Moreover, since the individual tubular cores fitted on each mandrel generally have different lengths from each other, errors may frequently occur as a result of the operator's failure to fit the cores in the correct order. Consequently there will no longer be a match between the sequence of the axial lengths of the tubular cores and the sequence of the transverse widths of the strips of web material which are fed to the mandrel for winding.

Furthermore, when this conventional procedure for preparing the mandrels is followed, the various tubular cores fitted on them are necessarily adjacent to each other. This means that the individual rolls which are formed on the mandrel are also necessarily adjacent to each other. This causes considerable problems, since the windings of one roll may interfere with those of an adjacent roll, giving rise to difficulties in the subsequent separation. The necessity of winding rolls on cores adjacent to each other entails further problems in cases in which the wound material is subject to shrinkage in respect of its width. This is because in this case there is a risk that the tubular cores will project from one or both ends of the finished roll, giving rise to difficulties in the subsequent operations of handling the rolls.

At the present time, if shrinkage of the wound material occurs during the rewinding stage, then, in order to prevent the projection of the cores from the finished rolls, the operator inserts a spacer between each core and the next in such a way that the cores remain inside the roll in each case. These spacers are in the form of open rings, to allow them to be inserted even when the cores have already been fitted on to the mandrel. The spacers are usually made from plastic material and are recovered at the end of the rewinding stage after the mandrel has been extracted. This system is unsatisfactory in that it is complicated, labor-intensive, and a source of errors on the part of the operator.

In rewinding machines of the aforementioned type, a set of cutters is placed upstream of the winding area in order to divide the web material taken from the reel into strips of the desired width. A computerized system is normally used to position the individual cutters correctly with respect to the transverse direction of the web material. The tubular cores, however, are cut to size (with core lengths which must match the widths of the individual strips into which the cutters divide the web material) in a different area of the plant, with a consequent risk of failure of matching between the positions of the cutters which cut the web material in the longitudinal direction and the axial dimensions of the individual tubular cores.

OBJECTS OF THE INVENTION

The object of the present invention is to provide an apparatus or device which makes it possible to overcome the disadvantages, the limitations and the possibilities of error of the conventional systems.

More particularly, a first object of the present invention is to provide a device and a method which permit the fast and accurate preparation of the mandrels with the corresponding tubular cores fitted on them for subsequent introduction into the rewinding machine.

A further object of the present invention is to provide a device and a method which make it possible to reduce the labor-intensiveness of cycles of winding or rewinding web materials.

Yet another object of the present invention is to provide a device and a method which make it possible to reduce or eliminate errors in the preparation of the mandrels for winding.

The object of an improved embodiment of the invention is to provide a method and a device which make it possible to automate the operations of preparing the cores and coordinating the cutting of the cores with the cutting of the web material, to achieve greater precision and speed.

An object of the present invention is also to provide a method and a device which avoid the disadvantages which are found in the rewinding of web materials which tend to shrink in the transverse direction, and also the problems arising from the difficulties of detaching rolls wound on adjacent cores carried by a single mandrel.

SUMMARY OF THE INVENTION

These and other objects and advantages, which the following text will make clear to those skilled in the art, are essentially achieved with a device comprising, in combination, an extraction station with an extractor mechanism for extracting a mandrel from one or more rolls of web material which has previously been wound and for inserting the extracted mandrel into a tube or core of cardboard or the like; a cutting station with cutting means for cutting the tube fitted on the mandrel, transforming it into a set of tubular cores aligned on the mandrel; and an insertion station with insertion members for inserting the mandrel with the tubular cores fitted on it into a rewinding machine or other winding machine.

These three stations enable the operations of preparing the tubular cores on the mandrel to be carried out in a partially or completely automatic way.

In the preferred embodiment of the invention, the three aforementioned stations are distributed spatially along a path which extends in a direction preferably orthogonal to the axis of the mandrel. This is particularly advantageous since it simplifies the design of the device and makes it possible to move the mandrel, while the tubular cores are being prepared on it, from the extraction position to the position of reinsertion into the rewinding machine, said two positions being normally spaced apart because of the presence of the winding members in an intermediate position. The use of three stations spaced apart also yields the advantage that it is possible to handle three mandrels simultaneously, one in the extraction station, one in the cutting station and the third in the insertion station.

On the other hand, the location of a plurality of stations, particularly two stations, in the same position in space is not excluded. For example, the cutting station can be spatially superimposed on or coincident with the extraction station, or the cutting station can be spatially coincident with or superimposed on the insertion station.

In a particularly advantageous embodiment of the invention, the extractor mechanism causes, by a single movement, the extraction of the mandrel from the finished roll or rolls and its insertion into the tube. On the other hand, the extraction from the finished roll or rolls and the insertion into a new tube by two separate movements is not excluded.

The extractor mechanism can be made with a pair of shaped wheels or rollers which are pressed against the outer surface of the mandrel and then made to rotate. Other systems of extracting the mandrel, for example by means of a pneumatic or hydraulic cylinder or the like, are not excluded. The use of powered shaped rollers makes the device particularly simple, economical and reliable, and also versatile in that it is easily adaptable to different mandrel diameters. It makes it particularly simple to insert the mandrel into a new tube at the same time as it is extracted from the finished roll.

Preferably, the mandrel used is of the expanding type, which is deflated before the extraction from the roll and re-inflated or expanded once it has been inserted into the tube. For this purpose, the extraction station comprises known means for deflating and inflating the mandrel.

In an advantageous embodiment, the extractor mechanism comprises a pair of shaped rollers which are pressed against the mandrel and made to rotate to move said mandrel in a direction parallel to its axis. This mechanism is particularly simple and enables the mandrel to be extracted and inserted into the tube efficiently, with a single movement. The shaped rollers can both be powered, but having one of them idle is not excluded.

A device for supporting the mandrels can advantageously be provided at the extraction station. In a possible embodiment, usable especially for long mandrels, the support device consists of a tube support cradle, made for example in the form of a roller train, a V-shaped section or the like. The support device, for example the aforesaid roller train, can be vertically movable so that it can be brought to a lower loading position, where it is easier to introduce the tube, and from there to an upper position for the insertion of the mandrel into the tube. The height of the second position is determined by the structure and size of the rewinding machine with which the device is associated. Advantageously, the positioning movement can be obtained by means of a gantry system with slides which move vertically along the uprights.

When the three stations, for extraction, cutting and insertion, are positioned so that they are separated from each other in space, means of transferring the mandrel from one to another will be provided. In a simple and economical embodiment, the transfer is carried out by rolling on inclined planes or rolling chutes. Suitable expulsion means, which push the mandrel, with the tube or tubular cores fitted on it, on to the corresponding inclined plane, are provided at the extraction station and/or at the cutting station.

The cutting station can comprise, in a possible embodiment, a pair of cylinders forming a cradle which supports the mandrel with the tube fitted on it for subsequent cutting into tubular cores. The rotation of the cylinders causes the mandrel supported on them to rotate correspondingly about its own axis. The possibility of imparting the rotary motion to the mandrel by other means, for example by means of a system of powered centers, is not excluded. The preferred system, with the pair of cylinders, is simpler in terms of construction and less critical in respect of tolerances.

The cutting station comprises one or more cutting heads, which in the preferred embodiment are located above the pair of cylinders, and each of which carries a cutting tool, preferably consisting of a discoid blade. The latter is preferably a smooth-edged blade and is idly supported.

The cutting tool is advantageously carried by an oscillating arm which controls its movements toward and away from the mandrel, although the possibility of using mechanisms of another type for moving the cutting tools toward and away from the mandrel is not excluded. The use of an oscillating arm is particularly advantageous in terms of mechanical simplicity. Additionally, in this way it is easy to provide a system of stops which define the operating position, in other words a plurality of operating positions of the tools, which can be selected alternatively according to the diameter of the mandrel and therefore of the tube to be cut.

Further advantageous characteristics and embodiments of the device according to the invention are described in the attached dependent claims.

The method according to the invention comprises the stages of extracting a mandrel from a roll or from a plurality of rolls formed in a rewinding machine or other; inserting the mandrel into a tube and fixing the tube with respect to the mandrel; cutting the tube fitted on the mandrel into a plurality of tubular cores aligned along said mandrel; and inserting the mandrel with the tubular cores fixed on it into a rewinding machine or other winding machine for the formation of rolls of web material on the individual cores.

In a particularly advantageous embodiment of the method according to the present invention, the mandrel is simultaneously extracted from the roll or rolls and inserted into the tube. Further advantageous characteristics of the method according to the invention are indicated, in the attached claims.

BRIEF DESCRIPTION OF THE DRAWINGS

The invention will be more clearly understood from the description and the attached drawing; which shows a non-restrictive embodiment of the invention. More particularly, the drawing shows.

DETAILED DESCRIPTION OF A PREFERRED EMBODIMENT

The device according to the invention is placed next to a rewinding or winding machine suitable for operation with expansion mandrels of a known type. In the attached drawing, the only parts of the rewinding machine which are indicated are two lower winding rollers 1 and 3 (see FIG. 2) and corresponding drive motors of the winding rollers, indicated by 5 and 7. The rewinding machine can be of any type, and by way of example it can be of the type described and illustrated in EP-A-0747308. However, it should be understood that the device according to the invention can be used with any winding system in which it is necessary to prepare a plurality of tubular cores on a common mandrel which is subsequently introduced into the winding area of the rewinding machine or other winding machine.

Figure 1:
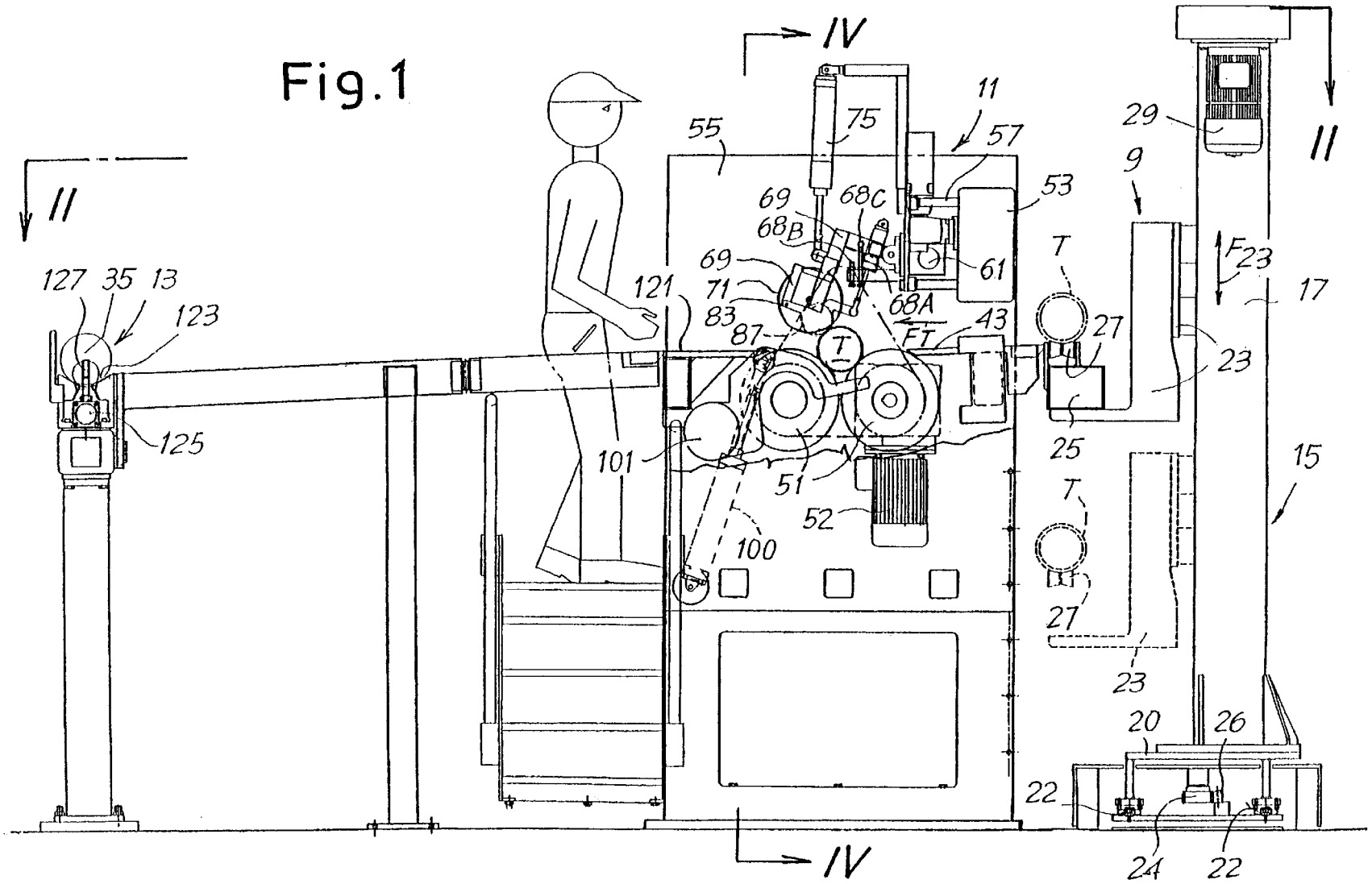
FIG. 1, a schematic side view of the device according to the invention.
Figure 2:
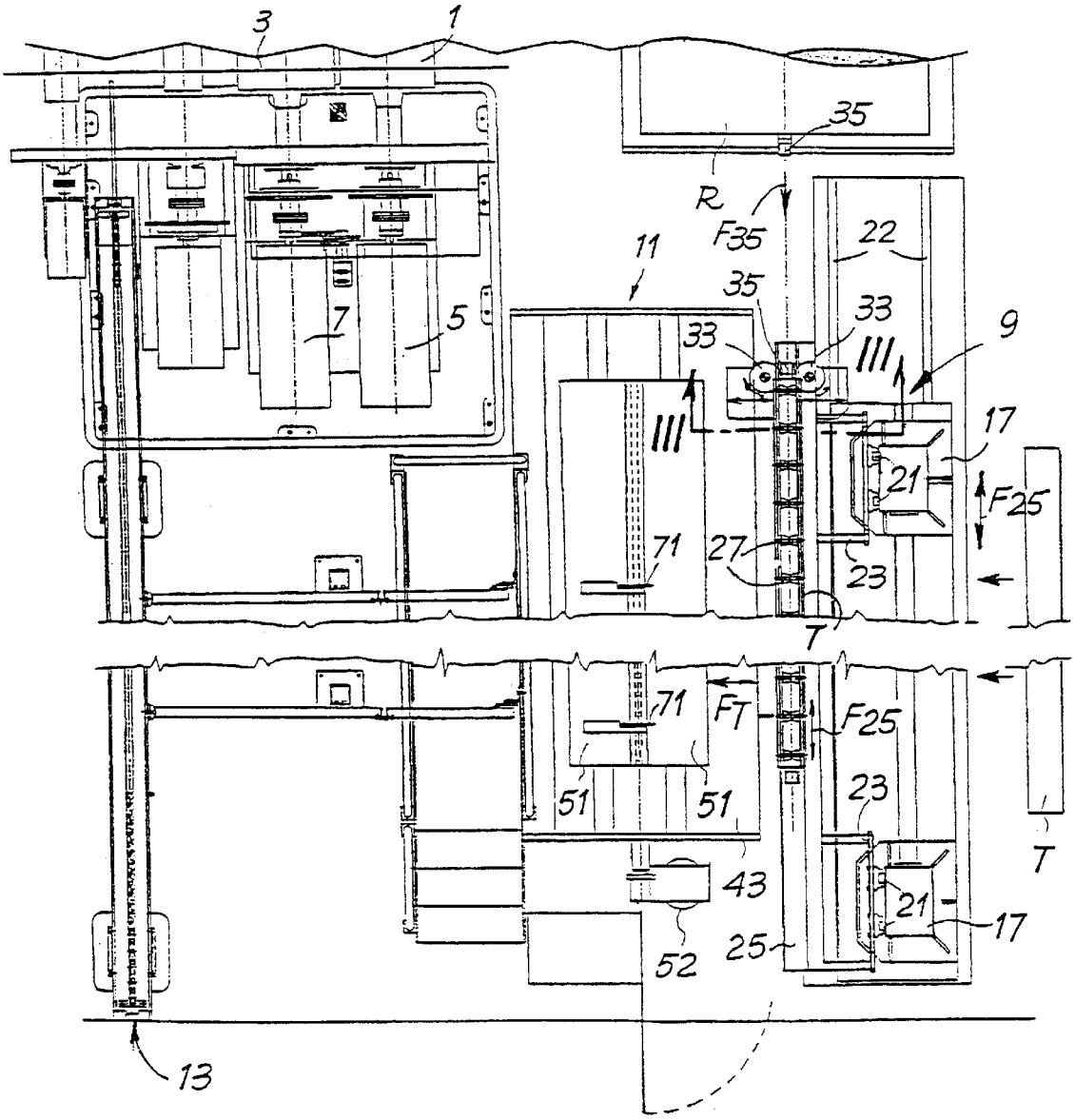
FIG. 2, a schematic plan view according to the line II—II in FIG. 1.

Schematically, the device according to the invention is divided into three stations, which are indicated in a general way by 9, 11 and 13 in FIGS. 1 and 2. The station 9 is a station for extracting the mandrel from a set of finished rolls aligned along the mandrel and produced by the rewinding machine, these rolls being partially visible in FIG. 1 and indicated therein by R. At the station 9, the mandrel which is extracted from the set of finished rolls is simultaneously inserted into a tube T which is fed to the device in the way described below by an operator or by an automatic loader.

The station 11 is a cutting station, in which the tube T fixed on the mandrel, which has been expanded at the station 9, is cut into a plurality of shorter tubular cores, matching the heights of the rolls which will be produced subsequently by the rewinding machine.

The station 13 is a station for inserting the mandrel, with the tubular cores cut to size and fixed on it, into the rewinding machine.

The three stations 9, 11 and 13 and their operation will be described individually in greater detail in the following text.

The station 9 has a gantry structure 15 comprising two uprights 17 linked by a crossbeam 19. Guides 21 extend along the uprights 17 to allow the sliding of two slides 23 which carry a beam structure 25 on which is mounted a roller train 27 which forms a cradle to accommodate a tube T, whose axial length is equal to the sum of the lengths of the individual tubular cores, and any necessary intermediate spacers, on which the rolls are formed simultaneously by means of the rewinding machine. The slides 23 are moved as shown by the arrow F23 (FIG. 1) along the guides 21 by means of a motor 29 associated with one of the uprights 17, using a recirculating ball screw system or equivalent (not shown). The roller train 27 can be brought by this vertical movement to a lower height, indicated in broken lines in FIG. 1, to which the operator can easily carry the tube T without having to raise it to an excessive height. The operation of loading the tube T can be automated by providing for the use of a suitable loader.

The subsequent raising of the roller train 27 brings the tube T to the height corresponding to that of the axis of the set of rolls R which have been produced by the rewinding machine and are ready to be discharged. This position is shown in solid lines in FIG. 1.

The gantry 15 is mounted on a carriage 20 movable on a pair of guides 22. The movement along said pair of guides is obtained by means of a pinion and rack system 24, 26 and is provided by a motor which is not shown. The movement of the gantry 15, the slides 23 and the roller train 27 in the direction of the guides 22 as shown by the arrow F25 enables the roller train to be brought up to and away from the rewinding machine where the roll R from which the mandrel has to be extracted is located. This makes it possible to provide a shorter roller train. Alternatively, the gantry 15 can be made to be fixed and the roller train can be made to have a greater longitudinal extension.

Figure 3:
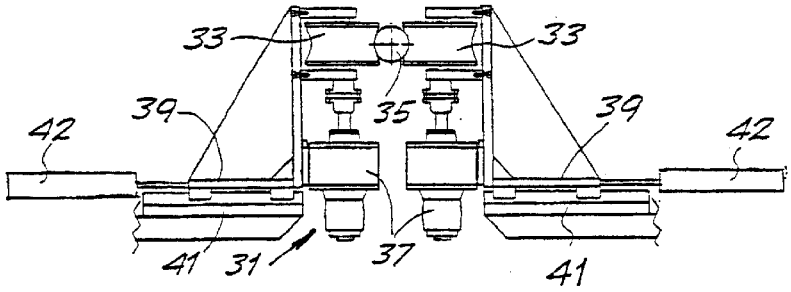
FIG. 3, a detail view according to the line III—III in FIG. 2.

An extractor mechanism 31, used to extract the mandrel from the set of finished rolls R and to insert it by the same movement into the tube T, is provided in a fixed position, or preferably carried on the beam 25. The extractor mechanism 31 has (see also FIG. 3) a pair of shaped rollers 33 covered with rubber or other material with a high coefficient of friction. Each shaped roller 33 is driven by a corresponding electric, pneumatic or hydraulic motor 37. Each assembly formed by a shaped roller 33 and the corresponding motor 37 is carried by a slide 39 which is movable along guides 41 so that it can be brought up to the mandrel 35. Cylinder and piston actuators, indicated schematically by 42, impart the movement to the slides 39 along the guides 41. This enables the shaped rollers 33 to be pressed against the mandrel regardless of its diameter.

The shaped rollers 33 are made to rotate in the directions shown schematically by the arrows in FIG. 2 (where the mechanism 31 is represented schematically). As a result of the friction between the surface of the mandrel 35 and the shaped surface of the rollers 33, the mandrel 35 (which has previously been deflated) is extracted from the rolls R by a movement as shown by the arrow F35. Since a new tube T has been previously positioned on the roller train 27, the movement of extraction of the mandrel 35 produced by the shaped rollers 33 causes the simultaneous insertion of the mandrel into the new tube T.

When the mandrel 35 has been inserted into the new tube T, it is inflated, in other words expanded in such a way that the tube T is fixed on it. The extraction station 9 is provided with means of deflating the mandrel before the extraction from the rolls R and means for the subsequent inflation or expansion after it has been introduced into the tube T. These means, which are known, are not represented in the drawing.

When the tube T has been fixed on the surface of the mandrel 35, the operator, or a suitable mechanical expulsion device, pushes the assembly formed by the mandrel 35 and the tube fitted on it along a rolling plate 43 or chute into the cutting station 11.

The cutting station 11 has a pair of cylinders 51 with parallel axes, forming a cradle which supports the mandrel 35 with the tube T fitted on it which arrives from the extraction station 9 by rolling as shown by the arrow FT along the rolling plane 43. The two cylinders 51 are rotated by a motor 52 carried by one of the two sides 55 of the cutting station 11.

A crosspiece 53 carried by the sides 55, on which two guides 57 are provided, extends above the cylinders 51. Two heads 59, which can move as shown by the arrow F59, run on the guides 57. The heads 59 are moved by two corresponding threaded bars 61 interacting with two nuts 62 carried by the heads 59. The number 63 indicates the motors which rotate the threaded bars 61. These bars are positioned at two different heights to enable the two heads to move along paths which partially overlap in the central area of the crosspiece 53.

Figure 4:
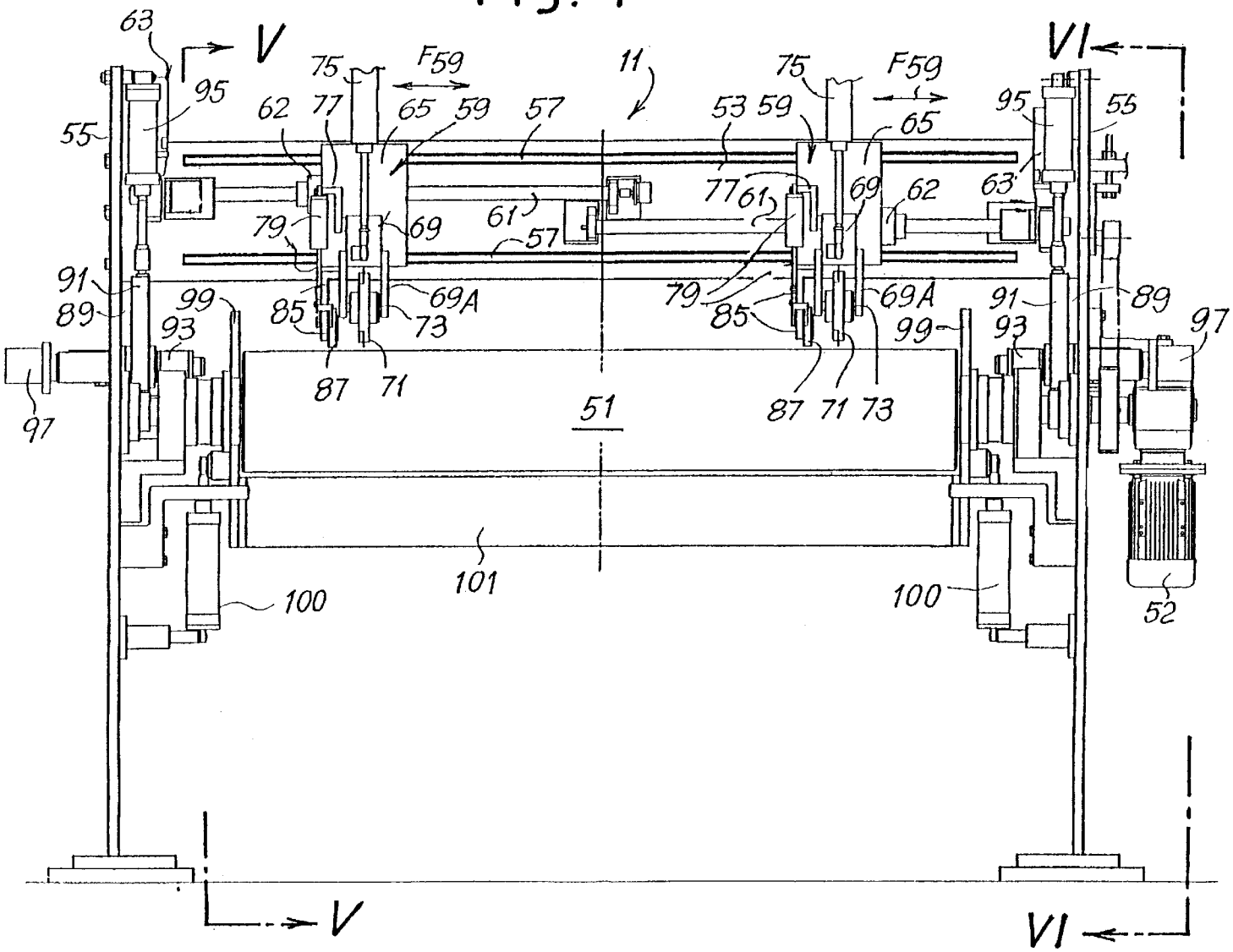
FIG. 4, a front view according to IV—IV in FIG. 1.

Each head 59 comprises (see in particular FIGS. 5, 5A and 5B) a slide 65 which can run on the guides 57 and carries a support 67 for an oscillating arm 69 carrying a cutting tool consisting of a discoid blade 71 which is free-running on a shaft 73 held by a fork 69A of the arm 69 (see FIG. 4). A cylinder and piston actuator 75 provides the oscillatory movement of the arm 69 about the support 67 to bring the discoid blade 71 alternately to an operating position and a nonoperating position. The oscillating arm 69 is integral with a bracket 77 on which is pivoted the cylinder of an air spring consisting of a cylinder and piston unit 79. The rod of the cylinder and piston unit 79 is pivoted on a rocker 81, which in turn is pivoted at 83 on a second bracket 85 carried by the oscillating arm 69. A pressure roller 87 is carried on the rocker 81 for the purposes indicated below.

Figure 5:
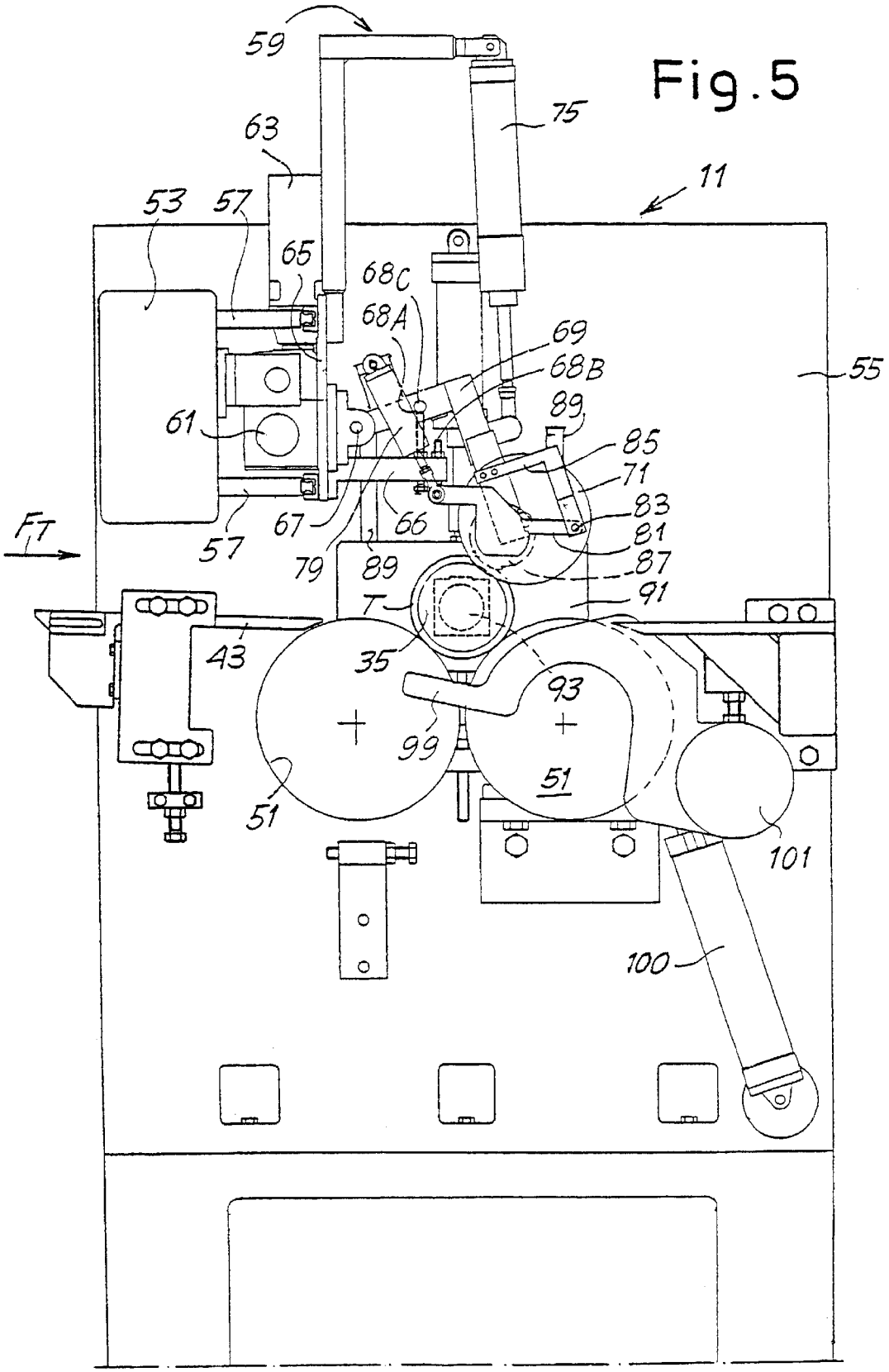
FIG. 5, a section through V—V in FIG. 4.
Figure 5A:
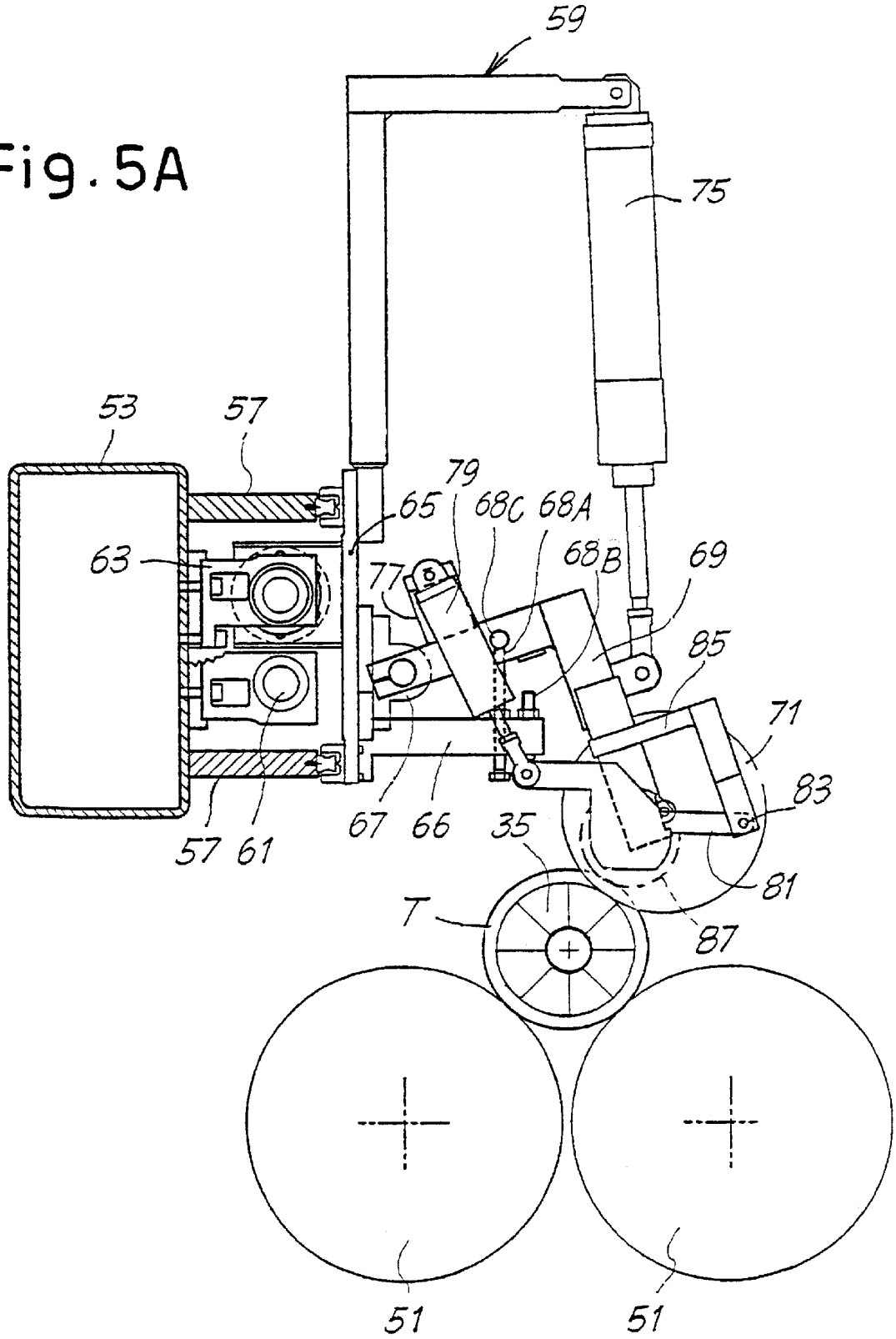
FIGS. 5A and 5B, enlarged side views of a head of the cutting station in two different configurations, corresponding to two different diameters of the mandrel and of the tube fitted on it.
Figure 5B:
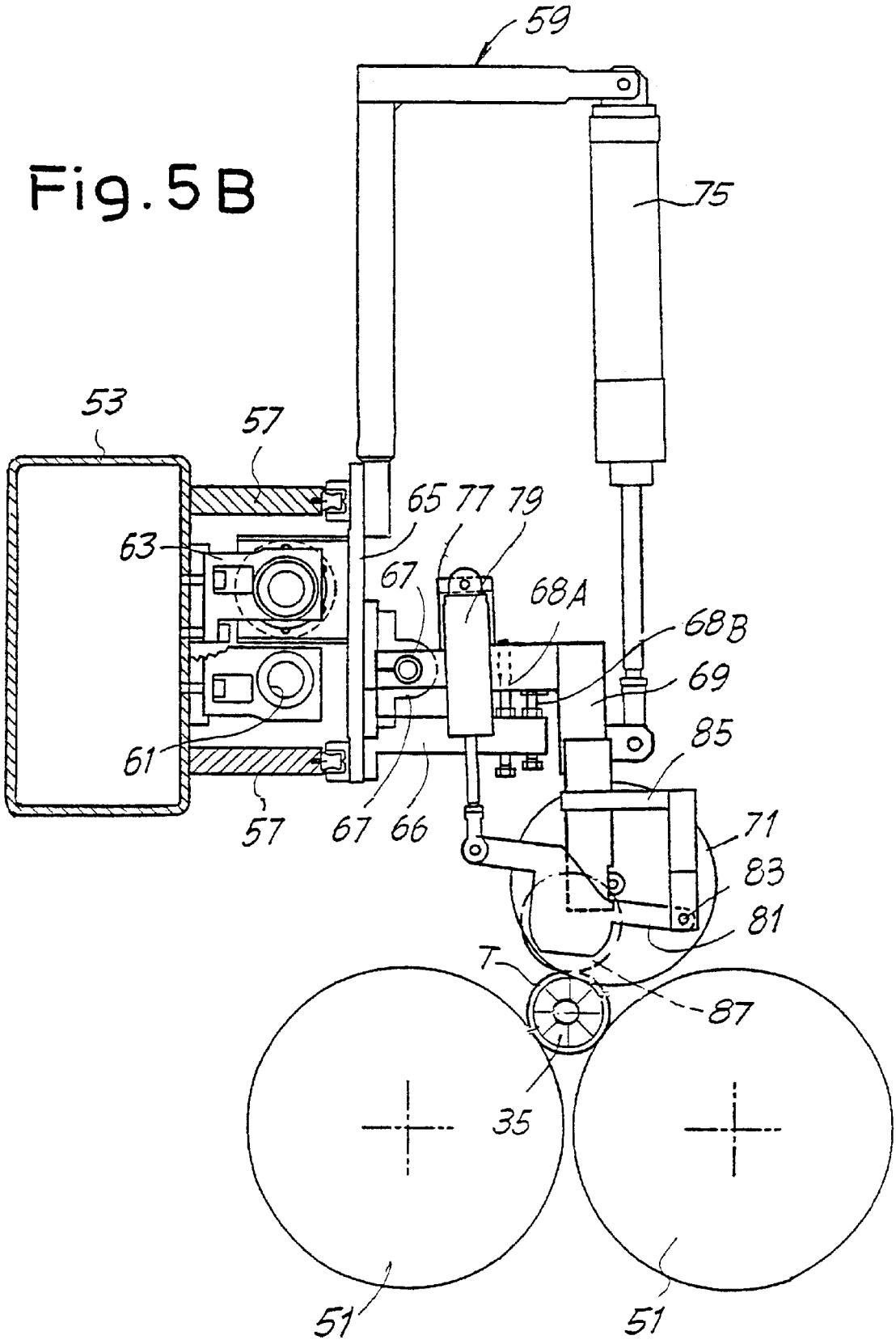
Figure 6:
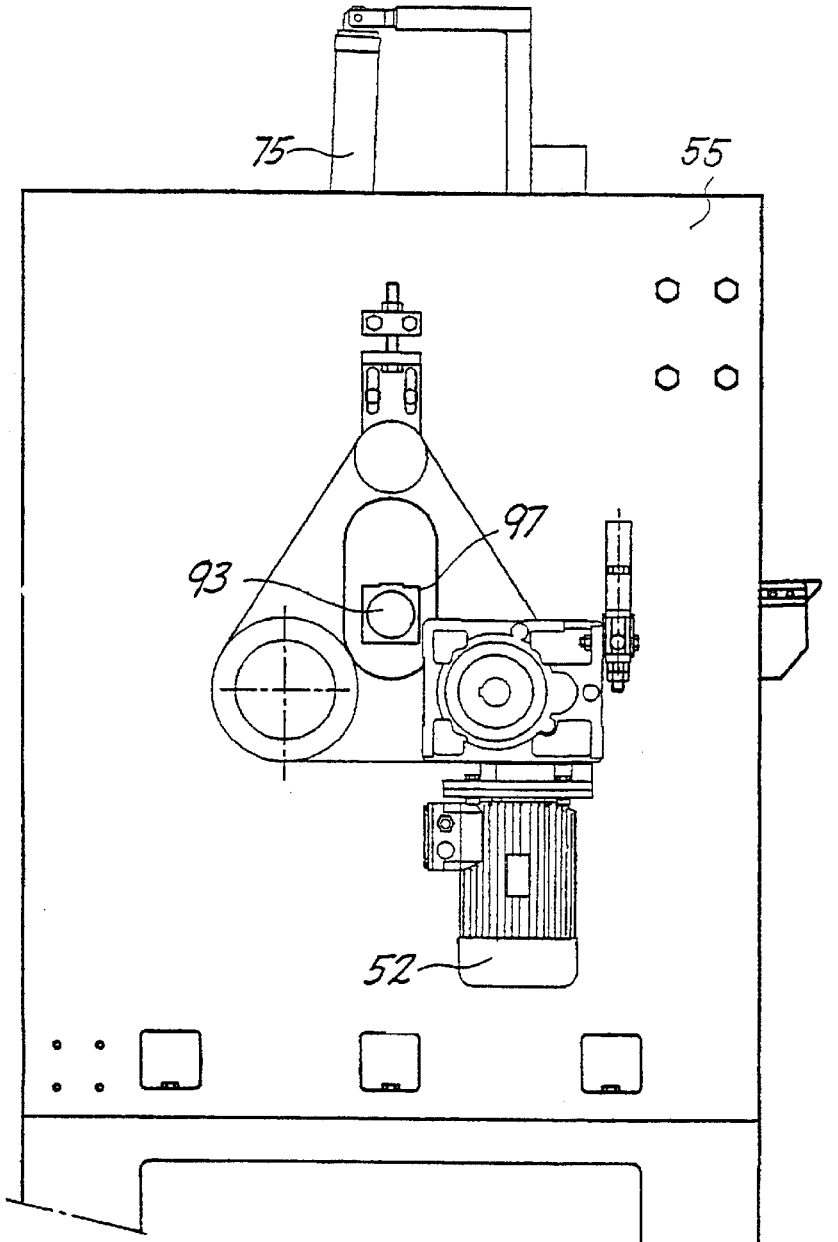
FIG. 6, a view according to VI—VI in FIG. 4.

A bracket 66 (visible in FIGS. 5, 5A and 5B), which carries a pair of adjustable stops 68A, 68B, is integral with the slide 65 of the head 59. The stop 68A interacts with a pin 68C fitted to the oscillating arm 69, while the stop 68B interacts with the arm 69 itself. The stop 68A is made inactive by removing the pin 68C. Thus the limit position (in other words the position of maximum oscillation in the clockwise direction) of the arm 69 will be determined by the stop 68A when the pin 68C is fitted to the arm 69, while it will be determined by the stop 68B when the pin 68C is removed from the arm 69. FIGS. 5A and 5B show in an enlargement the two different configurations of the stops for the cutting tool in the cases of mandrels having a small diameter (FIG. 5A) and a large diameter (FIG. 5B). In FIG. 5A, the pin 68C has been taken out, and the operating position of the cutting tool is determined by the stop 68B.

Each of the two sides 55 carries vertical guides 89 along which run corresponding plates 91, each carrying a center 93. The two centers 93 are aligned axially and their position can be adjusted in the vertical direction by means of corresponding actuators 95 carried by the sides 55. The actuators 95 move the plates 91 along the sliding guides 89 carried by the sides 55. Additionally, each center 93 is associated with a corresponding short-travel cylinder 97 which causes the corresponding center 93 to move in the, axial direction to move the centers 93 toward and/or away from each other.

A pair of expulsion arms 99 located outside the maximum dimensions of the cylinders 51 can oscillate about the axis 51A of the cylinder 51 which is furthest from the rolling plane 43. FIG. 5 shows one of the expulsion arms 99 in a first position, in which it is under the cradle formed by the rollers 51. FIG. 4 shows both of the expulsion arms 99 in a position elevated above the cylindrical surfaces of the cylinders 51. The oscillatory movement of the expulsion arms 99 is controlled by a cylinder and piston actuator 100, or—as shown in FIG. 4—by a pair of symmetrical actuators, again indicated by 100. The expulsion arms 99 are connected by a torsion bar 101.

The operation of the cutting station 11 is as follows. When a mandrel 35 with a tube T fitted on it reaches the cradle formed by the cylinders 51 by rolling on the rolling plane 43, it is fixed axially by means of the centers 93 which are brought toward each other by means of the short-travel cylinder 97. The centers 93 have previously been positioned in the vertical direction by the cylinder and piston actuators 95 so that they are located in the correct position according to the diameter of the tube T and the mandrel 35. It is also possible for one of the centers 93 to be axially movable and for the other to be fixed, and therefore without the short-travel cylinder 97, and for the movement of approach to each other to be carried out by the first center only. The centers are free to rotate about their own axes, which coincide with the axis of the mandrel 35.

When this configuration has been reached, the cylinders 51 are rotated by the motor 52. The starting of the rotation of the motor 51 before the positioning of the mandrel 35 in the cradle formed between them is not excluded. The heads 59 are brought (by a movement along the guides 57 by means of the threaded bars 61) to the positions in which the tube T is to be cut to form the tubular cores. During this movement, the oscillating arms 69 are kept in the raised position so that the discoid blades 71 do not interfere with the mandrel and the corresponding tube T lying below them. When it reaches the position in which the circumferential cut of the tube T is to be carried out, the head 59 is fixed and the oscillating arm 69 is lowered toward the cradle formed by the cylinders 51.

By this movement, the pressure roller 87 comes into contact with the outer surface of the tube T before the discoid blade 71. This provides the pressure between the tube T and the cylinders 51 necessary to keep the tube and the mandrel 35 fitted inside it in rotation by the effect of friction. As the downward movement of the arm 69 continues, the air spring 79 is compressed until the discoid blade 71 comes into contact with the tube T to be cut and passes through its thickness. The air spring 79 therefore also acts as a damper of the movement of the arm 69. The final position of the discoid blade 71 is determined by the stop 68A or 68B, as mentioned above, and is selected in such a way that the discoid blade 71 does not cut into the mandrel 35 which is located inside the tube T.

In the example in FIG. 5, the operating position is determined by the stop 68A. The head 59 maintains this position until the cutting of the tube T has been completed, after which the arm 69 is raised and the head is made to move to the next cutting position.

The operation is repeated for the requisite number of times, according to the number of tubular cores which are to be produced by cutting the tube T. It is possible to provide for the formation, between two adjacent cores, of a spacer ring formed by two consecutive circumferential cuts. In this way the consecutive tubular cores, on which the rolls of web material will be generated in the rewinding machine, can be kept separate from each other, thus preventing the finished rolls from having (as a result of the reduction of width of the web material) tubular cores which are longer than the heights of the rolls and consequently project from the rolls.

The cutting positions entered sequentially by the heads 59 can be controlled by a central control unit interfaced with the rewinding machine in such a way that there is an automatic co-ordination between the cutting positions of the heads 59 (and consequently the sizes of the tubular cores on the mandrel 35) and the positions of the cutters of the rewinding machine which carry out the continuous longitudinal cutting of the web material taken from the reel.

When the tube T has been completely divided into the various tubular cores, the assembly consisting of the mandrel 35 and the tubular cores fitted on it is discharged on to an inclined discharge plane 121 so that it reaches a channel 123 formed by the pair of V-sections forming part of the insertion station 13. The channel 123 is associated with a cylinder and piston actuator without a rod 125, provided with a pusher 127. The cylinder and piston actuator 125 pushes the mandrel 35 into the rewinding machine, where it undergoes a rewinding cycle of a known type.

The discharge of the assembly consisting of the mandrel 35 and the tubular cores from the cradle between the cylinders 51 of the cutting station 11 is carried out by the oscillation of the expulsion arms 99 about the axis 51A.

Figure 7:
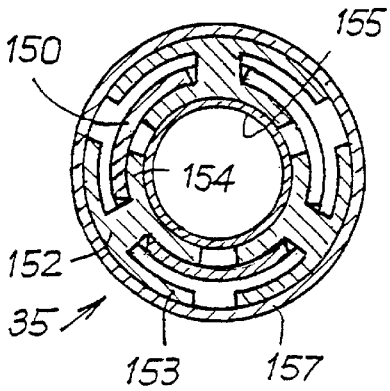
FIG. 7, a schematic cross section of an expanding mandrel usable in a device according to the invention.

The expanding mandrels may be of any shape. A detailed description of this member is not necessary, since it is of a known type. Purely by way of example, FIG. 7 shows a cross section of a possible expanding mandrel. This has a tubular element 150 with three slots extending in the axial direction and through which there extend corresponding stems 152 of expanding shoes 153, each of which has, at the radially outer end of the stem 15, a shell which extends in the form of a portion of a cylindrical surface. At the radially inner end of the stem 152, there is base element 154 which rests on a tubular air chamber 155 inside the element 150. A rubber sleeve 157, which forms the outer surface of the mandrel 35, is provided around the shells 153. In FIG. 7, the mandrel is shown in its expanded position, with the shells 153 in their radially outward position, the air chamber 155 being inflated. The mandrel is deflated by removing the excess pressure in the chamber 155. The radial retraction of the shells 153 is caused by the elasticity of the outer tubular sleeve 157. This sleeve can be replaced rapidly in case of wear, particularly if wear is caused by the cutting edges of the discoid blades 71.

It is to be understood that the drawing shows only a possible embodiment of the invention, which can be varied in its forms and arrangements without departure from the inventive concept on which the invention is based. The presence of any reference numbers in the attached claims does not limit the scope of protection of the claims, but has the sole purpose of facilitating the reading of the claims with reference to the preceding description and of the attached drawings.

What is claimed is:

1. Device for preparing winding mandrels for winding machines; the device comprising, in combination; an extraction station with an extractor mechanism for extracting a mandrel from at least one roll of web material and for inserting the extracted mandrel into a tube; a cutting station with cutting mean for cutting the tube fitted on the mandrel into a set of tubular cores aligned on the mandrel; an insertion station with insertion members for inserting the mandrel with the tubular cores into a winding machine.

2. Device according to claim 1, in which said extractor mechanism causes, by a single movement, the extraction of the mandrel from the finished at least one roll and its insertion into the tube.

3. Device according to claim 2, in which said extraction station comprises support devices for the tube, said support devices being aligned with the trajectory of the mandrel while it is extracted from a formed roll.

4. Device according to claim 3, in which said support device consists of a cradle.

5. Device according to claim 4, in which said extractor mechanism is positioned at one end of said cradle, and pushes the mandrel, while extracting it from said at least one roll, into the tube supported on said support cradle.

6. Device according to claim 4, in which said cradle is formed by a roller train.

7. Device according to claim 4, in which said support cradle is vertically movable between a lower position for loading said tube and an upper position for the extraction of the mandrel from the at least one roll.

8. Device according to claim 1, in which a chute is positioned between said extraction station and said cutting station for transferring the mandrel from the extraction station to the cutting station.

9. Device according to claim 1, in which said extractor mechanism comprises a pair of shaped rollers, at least one of which is powered, between which the mandrel to be extracted is gripped.

10. Device according to claim 9, in which both of the shaped rollers are powered.

11. Device according to claim 1, in which said extraction station comprises means for causing the deflation of the mandrel before it is extracted from the at least one roll and for its expansion after insertion into said tube.

12. Device according to claim 1, in which said cutting station comprises a pair of cylinders forming a rotation cradle for said mandrel and, above said cylinders, at least one head carrying a cutting tool, which is movable along the axial extension of said cylinders.

13. Device according to claim 12, in which said cutting tool is a discoid blade idly supported on said head.

14. Device according to claim 12, comprising at least two heads with corresponding cutting tools, said heads being movable along two parallel paths, independent actuating means being provided for said at least two heads.

15. Device according to claim 14, comprising, for each head, movement members extending parallel to the paths of said heads, and positioned at different heights.

16. Device according to claim 12, in which each of said heads carries a presser to press the mandrel against said cylinders.

17. Device according to claim 12, comprising a pair of centers for the centering and axial retention of the mandrel.

18. Device according to claim 17, in which said centers can be made to move toward and away from each other.

19. Device according to claim 17, in which said centers can be moved vertically to modify their position with respect to the surface of the cylinders.

20. Device according to claim 12, in which each of said heads has a moving support for the corresponding cutting tool, at least one stop to determine at least one operating position of said cutting tool, and an actuator to bring the cutting tool to said operating position or to a nonoperating position.

21. Device according to claim 20, in which said stop is adjustable.

22. Device according to claim 20, in which each head has stops for determining two alternative operating positions of the corresponding tool without the need for adjustment.

23. Device according to claim 12, comprising a control unit for controlling the movement of said head or heads, said control unit being connected to a rewinding machine provided with means of cutting a web material longitudinally, in such a way that the positions in which said head or heads cut the tube to form the tubular cores are controlled according to the position of the means of cutting the web material, or vice versa.

24. Device according to claim 12, in which the cutting station comprises a pair of oscillating arms for expelling the mandrel from said cutting station.

25. Device according to claim 12, in which said insertion station comprises an axial sliding channel for said mandrels and a pushing member for pushing said mandrels along said channel.

26. Device according to claim 12, in which a chute is positioned between said cutting station and said insertion station for transferring the mandrel between said two stations.

27. Method for preparing tubular winding cores on a winding mandrel, comprising the stages of: extracting a mandrel from a roll which has been formed; inserting the mandrel into a tube and fixing the tube with respect to said mandrel; cutting the tube into a plurality of tubular cores aligned along said mandrel; inserting the mandrel with the tubular cores fixed on it into a winding machine.

28. Method according to claim 27, in which said mandrel is simultaneously extracted from said roll and inserted into said tube.

29. Method according to claim 27, in which said mandrel is transferred orthogonally to its own axis from a first position, in which it is inserted into said tube, to a second position in which said tube is cut to form said plurality of tubular cores and from there to a third position from where it is moved axially to be inserted into said winding machine.

30. Method according to claim 29, in which said mandrel is transferred from said first and from said second position, and from the latter to said third position, by rolling.

31. Method according to claim 27, in which the mandrel is an expandable mandrel, and in which said mandrel is deflated before being extracted from said roll or rolls and then expanded when it has been inserted into said tube.

32. Method according to claim 27, in which said tube is cut by means of at least two cutting tools acting simultaneously.

33. Method according to claim 27, in which three mandrels are in operation simultaneously, the first being inserted into said tube, the second having the tube cut on it to form the tubular cores, and the third being in the process of insertion into a winding machine.

34. A method for winding web material onto tubular winding cores, the method comprising the steps of:

receiving a mandrel with a plurality of first tubular cores from a winding machine, the first plurality of cores being wound with web material;

extracting the mandrel from said plurality of first tubular cores wound with web material;

providing a tube;

inserting the mandrel into the tube substantially simultaneously with said step of extracting;

fixing the mandrel to the tube;

cutting the tube into a plurality of second tubular cores aligned along the mandrel;

winding web material onto said plurality of second tubular cores while said plurality of second tubular cores are arranged around the mandrel and fixed to the mandrel.

35. A method according to claim 34, in which said mandrel is transferred orthogonally to its own axis from a first position, in which it is inserted into said tube, to a second position in which said tube is cut to form said plurality of tubular cores and from there to a third position from where it is moved axially to be inserted into said winding machine.

36. A method according to claim 34, in which sad mandrel is transferred from said first and from said second position, and from the latter to said third position, by rolling.

37. A method according to claim 34, in which the mandrel is an expandable mandrel, and in which said mandrel is deflated before being extracted from said roll or rolls and then expanded when it has been inserted into said tube.

38. A method according to claim 34, in which said tube is cut by means of at least two cutting tools acting simultaneously.

39. A method according to claim 34, in which three mandrels are in operation simultaneously, the first being inserted into said tube, the second having the tube cut on it to form the tubular cores, and the third being in the process of insertion into a winding machine.

40. A device for preparing winding mandrels for winding machines the device comprising;

an extraction station with an extractor mechanism for extracting a mandrel from at least one roll of web material and for inserting the extracted mandrel into a tube by a single movement;

a cutting station with cutting means for cutting the tube fitted on the mandrel into a set of tubular cores aligned on the mandrel; and an insertion station with insertion members for inserting the mandrel with the tubular cores into a winding machine.

41. A device according to claim 40, wherein said extraction station comprises support devices for the tube, said support devices being aligned with the trajectory of the mandrel while it is extracted from a formed roll.

42. A device according to claim 41, wherein said support device consists of a cradle.

43. A device according to claim 42, which said cradle is formed by a roller train.

44. A device according to claim 42, in which said support cradle is vertically movable between a lower position for loading said tube and an upper position for the extraction of the mandrel from the at least one roll.

45. A device according to claim 40, which a chute is positioned between said extraction station and said cutting station for transferring the mandrel from the extraction station to the cutting station.

46. A device according to claim 40, which said extractor mechanism comprises a pair of shaped rollers, at least one of which is powered, between which the mandrel to be extracted is gripped.

47. A device according to claim 46, in which both of the shaped rollers are powered.

48. A device according to claim 40, in which said extraction station comprises means for causing the deflation of the mandrel before it is extracted from the at least one roll and for its expansion after insertion into said tube.

49. A device according to claim 40, which said cutting station comprises a pair of cylinders forming a rotation cradle for said mandrel and, above said cylinders, at least one head carrying a cutting tool, which is movable along the axial extension of said cylinders.

50. A device according to claim 49, which said cutting tool is a discoid blade idly supported on said head.

51. A device according to claim 50, comprising at least two heads with corresponding cutting tools, said heads being movable along two parallel paths, independent actuating means being provided for said at least two heads.

52. A device for preparing winding mandrels for winding machines the device comprising:

an extraction station with an extractor mechanism for extracting a mandrel from at least one roll of web material and for inserting the extracted mandrel into a tube, said extraction station comprising a support device for the tube, said support device being aligned with the trajectory of the mandrel while it is extracted from a formed roll, said support device comprising a cradle, in which said extractor mechanism is positioned at one end of said cradle, and pushes the mandrel, while extracting it from said at least one roll, into the tube supported on said support cradle;

a cutting station with cutting means for cutting the tube fitted on the mandrel into a set of tubular cores aligned on the mandrel;

an insertion station with insertion members for inserting the mandrel with the tubular cores into a winding machine.

* * * * *